US005735521A

United States Patent [19]

Klimpert

[11] Patent Number: 5,735,521

[45] Date of Patent: Apr. 7, 1998

[54] PUZZLE WITH TEXTURED SURFACE

[75] Inventor: Randall Jon Klimpert, Wilmette, Ill.

[73] Assignee: Meyer/Glass Design, Ltd., Chicago, Ill.

[21] Appl. No.: 733,530

[22] Filed: Oct. 18, 1996

[51] Int. Cl.[6] ..... A63F 9/10

[52] U.S. Cl. ..... 273/157 R

[58] Field of Search ..... 273/153 R, 156, 273/157 R; 446/901, 100

[56] References Cited

U.S. PATENT DOCUMENTS

| | | | |
|---|---|---|---|
| Re. 19,238 | 7/1934 | Burke | 273/157 R |
| 2,013,395 | 9/1935 | Wood | 273/157 R |
| 2,327,718 | 8/1943 | Kassler | 273/157 R |
| 2,843,970 | 7/1958 | Keuls | 273/157 R |
| 3,281,966 | 11/1966 | Johnson | 273/157 R |
| 3,779,558 | 12/1973 | Moreau | 273/157 R |
| 4,336,020 | 6/1982 | Zacharin | 273/157 R |
| 4,403,000 | 9/1983 | Gates | 446/901 |
| 4,719,656 | 1/1988 | Godinet | 273/157 R |

FOREIGN PATENT DOCUMENTS

| | | | |
|---|---|---|---|
| 409838 | 5/1934 | United Kingdom | 446/901 |

*Primary Examiner*—Steven B. Wong
*Attorney, Agent, or Firm*—Marc J. Whipple

[57] ABSTRACT

A textured surface improvement for puzzles is disclosed. A flocking material is applied to selected areas of a multi-piece puzzle. If the puzzle portrays an image, the areas and flocking are matched to provide greater realism and entertainment value. The flocking material also guides the user and makes the puzzle easier to reassemble.

10 Claims, 1 Drawing Sheet

PUZZLE WITH TEXTURED SURFACE

BACKGROUND OF THE INVENTION

Puzzles Generally

Puzzles, especially "jigsaw" puzzles with two dimensional images divided into interlocking pieces, are well-known in the toy and game art. Such a puzzle normally consists of an image printed on cardboard, chipboard, wood, or plastic, with the image divided into a plurality of pieces which interlock or abut in a predesigned manner. The user attempts to correctly arrange the pieces to reconstruct the image.

Typical puzzles may be made of materials with varying thickness, but have a two-dimensional appearance. This limits the realistic appearance of the image. Further, many puzzles are quite difficult for young children to solve, due to the limited information available and the repetition of color and pattern on more than one piece. This limitation also affects the sight-impaired, who would benefit from non-visual cues in the reassembly of such puzzles. Finally, a two-dimensional image provides a limited entertainment value to the user, especially if the user is a child. Puzzles with sculpted or relief features are old in the art, but are much more expensive and difficult to produce. It would be beneficial to improve puzzles in such a way as to make them more entertaining, easier to solve, and more realistic, while holding costs down. The present invention addresses these concerns.

OBJECTS OF THE INVENTION

An object of the invention is to provide a textured surface improvement for puzzles.

A second object of the invention is to provide a puzzle which is easier to solve due to the additional guidance to the user provided by the textured surface improvement.

A third object of the invention is to provide a puzzle which is more entertaining due to the textured surface improvement.

A fourth object of the invention is to provide a puzzle which is more realistic due to the addition of a textured surface improvement.

Other objects and advantages of the invention will become apparent in the following disclosure.

SUMMARY OF THE INVENTION

The present invention relates to multi-piece assembly puzzles such as "jigsaw" puzzles. A flocking material is applied to selected areas of a multi-piece puzzle. If the puzzle portrays an image, the areas and flocking are matched to provide greater realism and entertainment value. This is especially helpful in providing tactile stimulation and maintaining interest in younger users. In any event, the flocking material also guides the user and makes the puzzle easier to reassemble. Again, this is especially desirable to provide additional information to the younger user in the reassembly process.

BRIEF DESCRIPTION OF THE DRAWINGS

The characteristic features of the invention will be particularly pointed out in the claims. The descriptions of the preferred embodiment refer to the preceding drawings:

DESCRIPTION OF THE PREFERRED EMBODIMENT

The description of the preferred embodiment uses the invention in a puzzle showing a human profile with hair. The term "flocking material" includes any particulate or granular material which is desired to create a certain effect or impression. In the description of the preferred embodiment, the flocking should be understood to be a soft material, appropriately colored, such as nylon filament, although this is not required.

Figure 1:
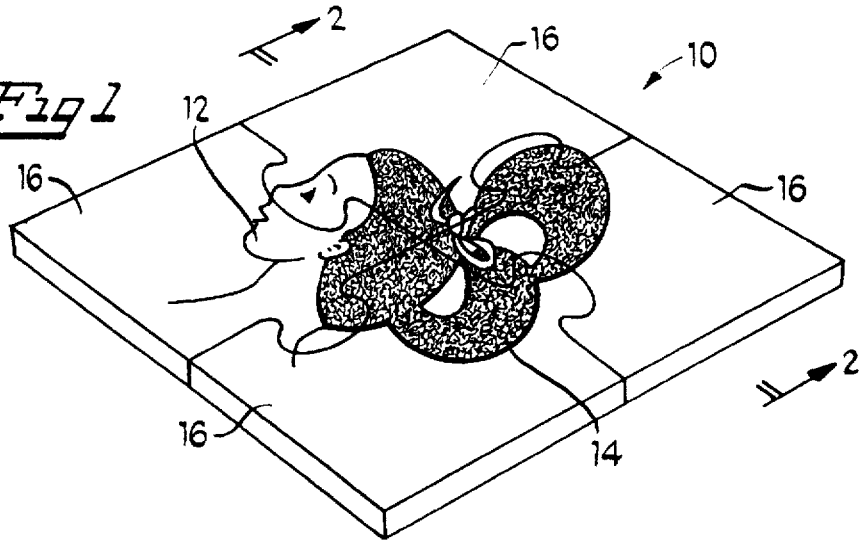
FIG. 1 is a representational view of the entire apparatus.

By referring to FIG. 1, the basic concept of the invention may be easily understood. Puzzle 10 has printed upon it an image 12, here a human profile. Image 12 contains areas which suggest a certain texture, namely, the hair of the head and the hair bow. Flocked surface 14 coincides with this area, giving the hair and bow a soft texture. (See FIG. 2.) Puzzle 10 is divided in any desired manner into a plurality of pieces 16. Pieces 16 may be disassembled and reassembled by means of interlocking edges. The nature of the interlocking edges may be as simple or as complex as desired, according to the level of difficulty desired. Similarly, the number of pieces 16 may be varied to control the complexity of puzzle 10.

Figure 2:
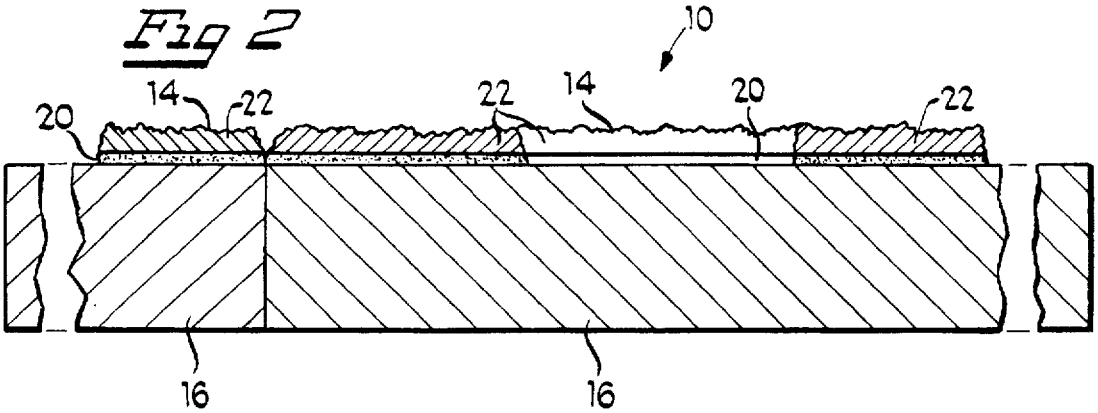
FIG. 2 is a cross-sectional view of the apparatus showing its various layers.

FIG. 2 shows the construction of a flocked surface. In the preferred embodiment, image 12 (Not Shown: See FIG. 1) is preprinted on puzzle 10. Glue 20 is then applied to the areas of image 12 which are to have a textured surface. This may be done all at once or in stages, depending on the complexity of the surface desired. Flocking 22 is then applied to glue 20, where it adheres, forming a flocked surface 14. It is preferred to create the flocked surface 14 before puzzle 10 is cut into pieces 16, but this is not necessary. The flocked surface 14 provides additional visual and tactile cues to the user as to the proper orientation of the pieces 16 during the reassembly process. Careful selection of color and texture in flocking 22 will also enhance the realism of image 12.

While the description above details the preferred and best mode of practicing the invention, many other configurations and variations are possible. For example:

1) The invention need not be practiced as a picture puzzle, but could be used for any desired entertainment or educational purpose, for instance as a progress indicator or "payoff" in a game of chance or skill. The "image" may or may not represent a real object.
2) The surface need not be flocked with a soft material; a hard particulate could be used to provide a gritty, glittery, or sandy surface, etc.
3) The puzzle need not be two-dimensional, but could be a three-dimensional "sculpture" puzzle with appropriately textured surfaces.

Accordingly, the scope of the invention should be determined not by the embodiment(s) illustrated, but by the claims below and their equivalents.

The above discussion shows that the present invention makes possible a textured surface improvement for puzzles. Also, the invention makes possible a puzzle which is easier to solve due to the additional guidance to the user provided by the textured surface improvement. Further, the invention is to provides a puzzle which is more entertaining due to the textured surface improvement. Finally, the invention provides a puzzle which is more realistic due to the addition of a textured surface improvement. Therefore, the protection of a patent is requested for the invention as set forth in the claims below.

What is claimed is:

1. A method of manufacturing a multi-piece puzzle with a visible textured surface area, comprising the steps of:

a) Selecting an image comprising a plurality of areas to comprise the multi-piece puzzle;

b) Applying an adhesive to an area of the image;

c) Applying a flocking material to the area covered by the adhesive to form a textured surface area, and;

d) Separating the image into a plurality of pieces to form the multi-piece puzzle which may be disassembled and reassembled, wherein the image and the textured surface area are visible when the pieces are in the correct orientation for reassembly.

2. A method of manufacturing a multi-piece puzzle with a textured surface area as in claim 1, wherein the adhesive is a permanent liquid adhesive which dries completely after application.

3. A method of manufacturing a multi-piece puzzle with a textured surface area as in claim 1, wherein the second and third steps are repeated as desired to create a plurality of textured surface areas.

4. A method of manufacturing a multi-piece puzzle with a textured surface area as in claim 3, wherein the adhesive is a permanent liquid adhesive which dries completely after application.

5. A method of manufacturing a multi-piece puzzle with a textured surface area, comprising the steps of:

a) Selecting an image comprising a plurality of areas to comprise the puzzle;

b) Separating the image into a plurality of pieces to form a multi-piece puzzle which may be disassembled and reassembled;

c) Applying an adhesive to an area of the image, and;

d) Applying a flocking material to the area covered by the adhesive to form a textured surface area, wherein the image and the textured surface area are visible when the pieces are in the correct orientation for reassembly.

6. A method of manufacturing a multi-piece puzzle with a textured surface area as in claim 5, wherein the adhesive is a permanent liquid adhesive which dries completely after application.

7. A method of manufacturing a multi-piece puzzle with a textured surface area as in claim 5, wherein the third and fourth steps are repeated as desired to create a plurality of textured surface areas.

8. A method of manufacturing a multi-piece puzzle with a textured surface area as in claim 7, wherein the adhesive is a permanent liquid adhesive which dries completely after application.

9. A multi-piece puzzle with a textured surface area, comprising:

a) A plurality of pieces, which form a multi-piece puzzle which may be disassembled and reassembled;

a) An image comprising a plurality of areas, the image being visibly represented on the pieces;

c) An adhesive which is applied to an area of the image, and;

d) A flocking material which is applied to the area covered by the adhesive to form a textured surface area, wherein the image and the textured surface area are visible when the pieces are in the correct orientation for reassembly.

10. A multi-piece puzzle with a textured surface area as in claim 9, wherein the adhesive is a permanent liquid adhesive which dries completely after application.

* * * * *